US008152326B2

(12) United States Patent
House et al.

(10) Patent No.: US 8,152,326 B2
(45) Date of Patent: Apr. 10, 2012

(54) CONTAINER HAVING A LIGHT SOURCE

(75) Inventors: Richard F. House, Geneva, IL (US); Stephen M. Pinney, Naperville, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 456 days.

(21) Appl. No.: 12/427,926

(22) Filed: Apr. 22, 2009

(65) Prior Publication Data

US 2009/0266734 A1 Oct. 29, 2009

Related U.S. Application Data

(60) Provisional application No. 61/047,340, filed on Apr. 23, 2008.

(51) Int. Cl.
*F21V 33/00* (2006.01)

(52) U.S. Cl. ..... 362/154; 362/382

(58) Field of Classification Search ..... 362/154, 362/352, 362, 249.01, 249.02, 249.06, 249.05, 362/382; 206/418, 419, 420
See application file for complete search history.

(56) References Cited

U.S. PATENT DOCUMENTS

| | | | | |
|---|---|---|---|---|
| 4,286,399 | A | 9/1981 | Funahashi et al. | |
| 4,363,081 | A | 12/1982 | Wilbur | |
| 4,497,126 | A | 2/1985 | Dejean | |
| 4,607,747 | A | 8/1986 | Steiner | |
| 5,063,698 | A | 11/1991 | Johnson et al. | |
| 5,147,129 | A | 9/1992 | Ku | |
| 5,161,882 | A * | 11/1992 | Garrett | 362/249.01 |
| 5,217,286 | A | 6/1993 | Ming-ho | |
| 5,243,504 | A | 9/1993 | Sejzer | |
| 5,366,780 | A | 11/1994 | Rapisarda | |
| 5,400,229 | A * | 3/1995 | Lin | 362/249.02 |
| 5,523,741 | A | 6/1996 | Cane | |
| 5,575,098 | A | 11/1996 | Goettel-Schwartz | |
| 5,597,070 | A * | 1/1997 | Wu | 206/419 |

(Continued)

FOREIGN PATENT DOCUMENTS

JP 2004-41613 2/2004

(Continued)

OTHER PUBLICATIONS

PCT/US2009/041364—International Search Report and Written Opinion, Dec. 2, 2009, Graphic packaging International, Inc. et al.

*Primary Examiner* — Thomas Sember
(74) *Attorney, Agent, or Firm* — Womble Carlyle Sandridge & Rice, LLP

(57) ABSTRACT

A container constructed from a blank of foldable sheet material is provided. The container includes a shell having at least one side wall, a bottom wall, and at least one opening defined through the at least one side wall. The at least one side wall having an interior surface and an exterior surface. The container also includes a liner having an interior surface and an exterior surface. The liner includes at least one light source coupled to the exterior surface of the liner. The liner is coupled to the shell. At least a portion of the exterior surface of the liner is adjacent to the interior surface of the shell, and the at least one light source is aligned with the at least one opening for emitting light therethrough.

31 Claims, 7 Drawing Sheets

U.S. PATENT DOCUMENTS 5,717,574 A * 2/1998 Gustafson ..... 361/752
5,923,242 A 7/1999 Slagle et al.
5,955,958 A 9/1999 Lu
5,980,062 A 11/1999 Bell
6,020,823 A 2/2000 DeCicco
6,298,990 B1 10/2001 Amrod et al.
6,318,882 B1 11/2001 Chang
6,568,828 B2 5/2003 Rudoy
6,573,880 B1 6/2003 Simoni et al.
6,771,165 B2 8/2004 Burg, II et al.
7,064,498 B2 6/2006 Dowling et al.
7,086,751 B2 8/2006 Clark
7,198,383 B2 4/2007 Martino
2002/0048169 A1 4/2002 Dowling et al.
2002/0070688 A1 6/2002 Dowling et al.
2003/0210141 A1 11/2003 Iacovino
2004/0032732 A1 2/2004 Rubin
2004/0150983 A1 8/2004 Sexton et al.
2004/0264179 A1 12/2004 Clark
2005/0237006 A1 10/2005 Lee
2006/0012994 A1 1/2006 Martino
2006/0139928 A1 6/2006 Griffiths et al.
2007/0121321 A1 5/2007 Cheng

FOREIGN PATENT DOCUMENTS

JP 2007-275086 10/2007

* cited by examiner

CONTAINER HAVING A LIGHT SOURCE

CROSS-REFERENCE TO RELATED APPLICATION

This application claims the benefit of U.S. Provisional Application No. 61/047,340, which was filed on Apr. 23, 2008. The entire disclosure of the above-referenced provisional application is hereby incorporated by reference for all purposes as if presented herein in its entirety.

BACKGROUND OF THE DISCLOSURE

The present disclosure generally relates to containers or cartons for holding a product, and more particularly, to a container or carton having a light source.

SUMMARY OF THE DISCLOSURE

In one aspect, the disclosure is generally directed to a container constructed from at least a first blank and a second blank. The container comprises a shell constructed from at least the first blank and having a side wall. The side wall comprises an opening. The container further comprises a bottom wall, and a liner constructed from at least the second blank. The liner is attached to the shell and comprises a light source. The light source is aligned with the opening.

In another aspect, the disclosure is generally directed to a method of forming a container. The method comprises having a first blank. The first blank is comprised of a side wall and an opening in the side wall. A second blank has a light source attached thereto. The second blank is positioned relative to the first blank to substantially align the light source with the opening.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Exemplary embodiments of the present disclosure provide a container having an liner or electronic insert, and a method of constructing the same. In one embodiment, the container is fabricated from a paperboard material. The container, however, may be fabricated using any suitable material, and therefore is not limited to a specific type of material. In alternative embodiments, the container is fabricated using cardboard, plastic, substantially transparent material, substantially opaque material, and/or any suitable material known to those skilled in the art and guided by the teachings herein provided. Moreover, the container may have any suitable size, shape and/or configuration. In the example embodiment, the container is oval-shaped or substantially elliptical.

In one embodiment, the container includes a marking thereon including, without limitation, indicia that communicates the product, a manufacturer of the product and/or seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided.

Figure 1:
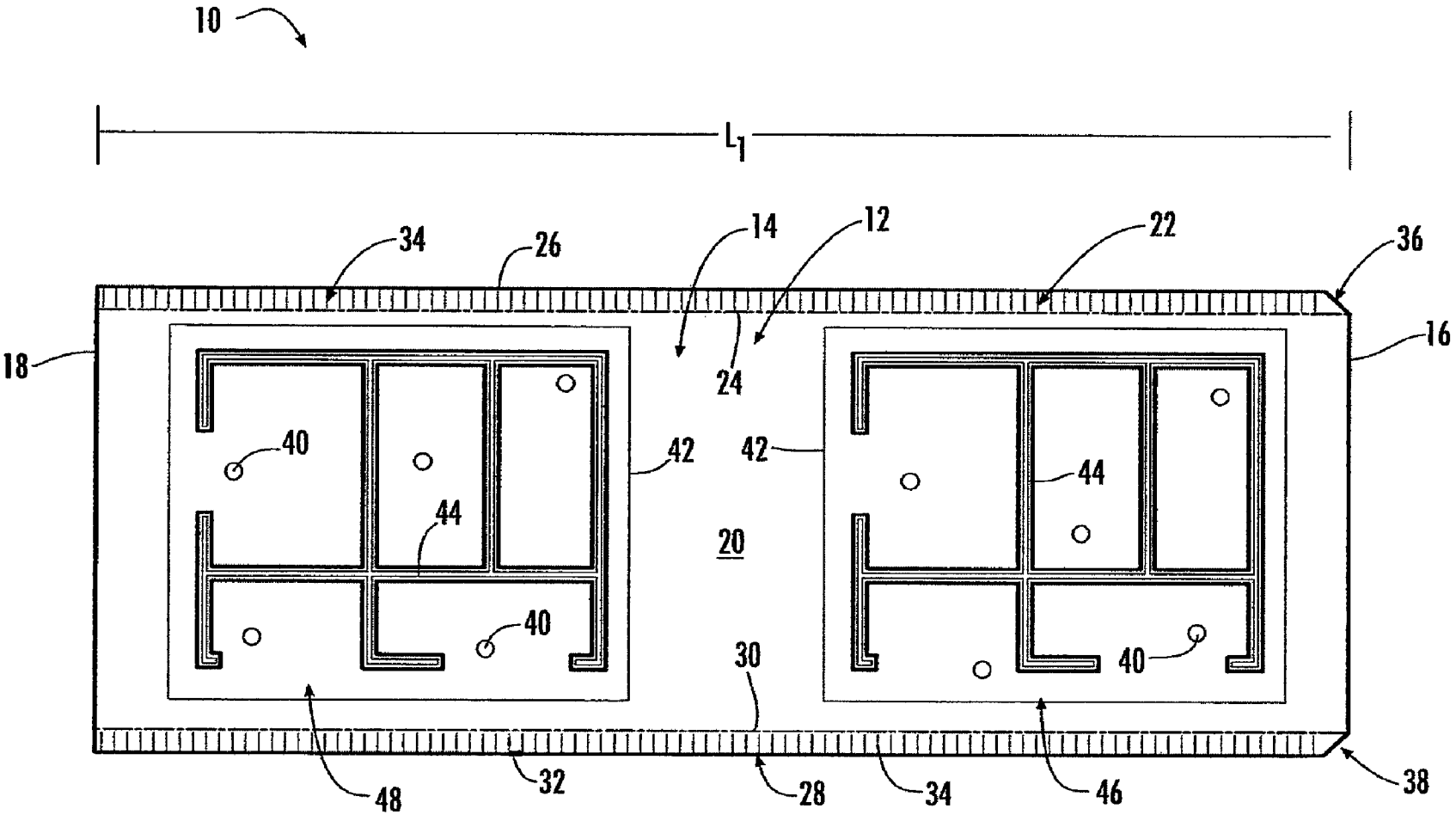
FIG. 1 is a top plan view of a blank of sheet material for constructing a container, according to one embodiment of the present disclosure.
Figure 5:
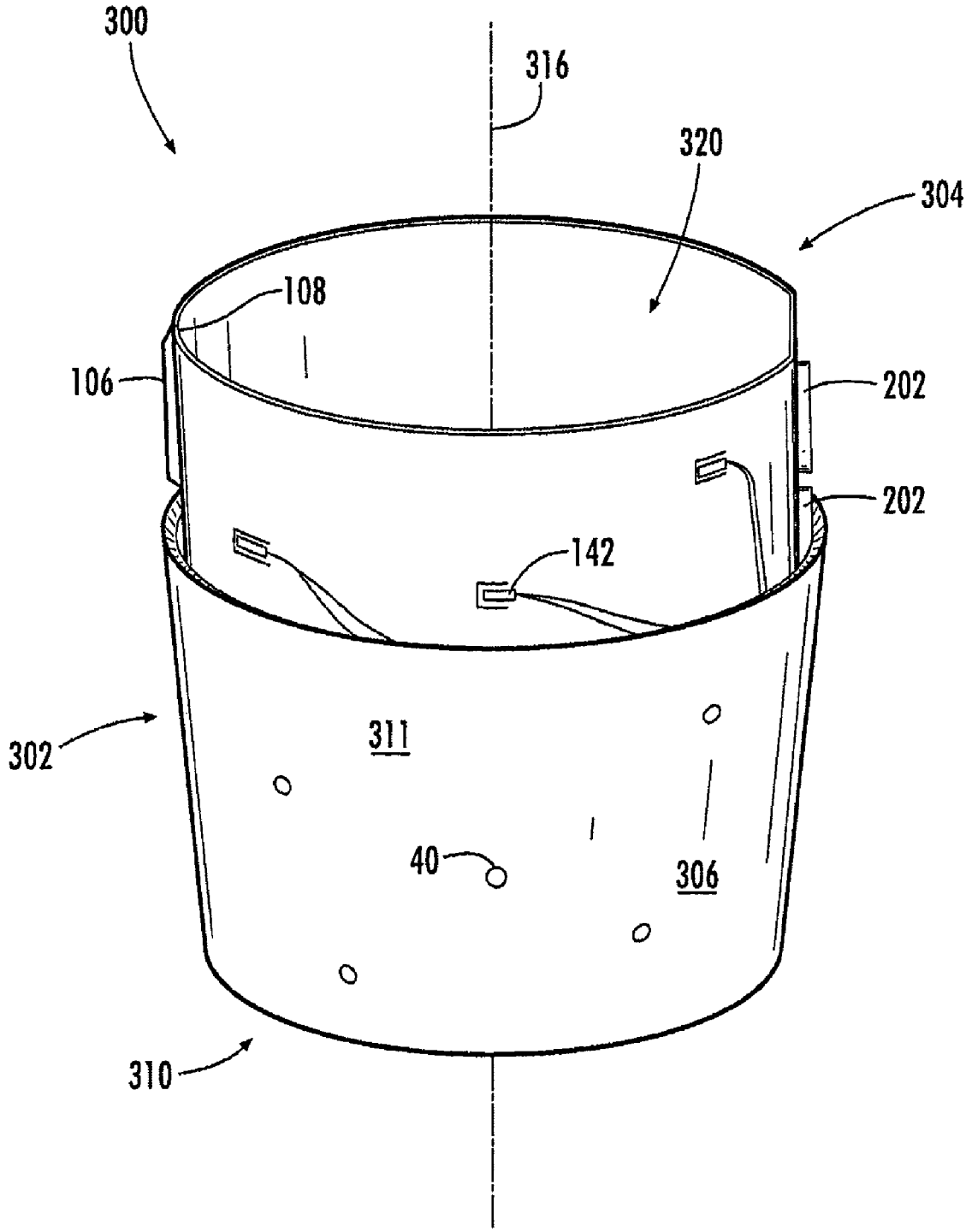
FIG. 5 is a perspective view of a container formed from the blanks shown in FIGS. 1 and 2.
Figure 6:
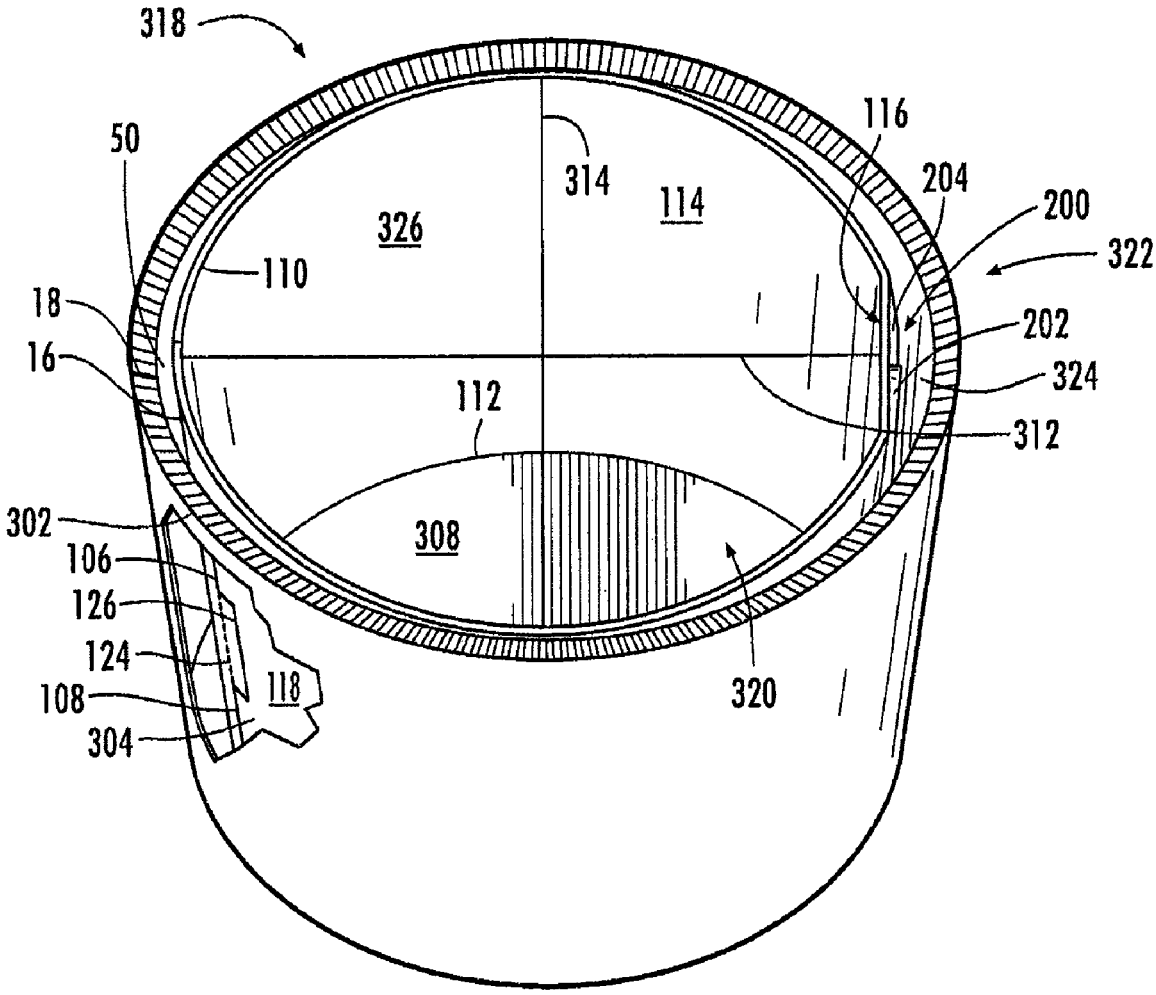
FIG. 6 is a top perspective of the container shown in FIG. 5 with a portion of the container removed to show detail.
Figure 7:
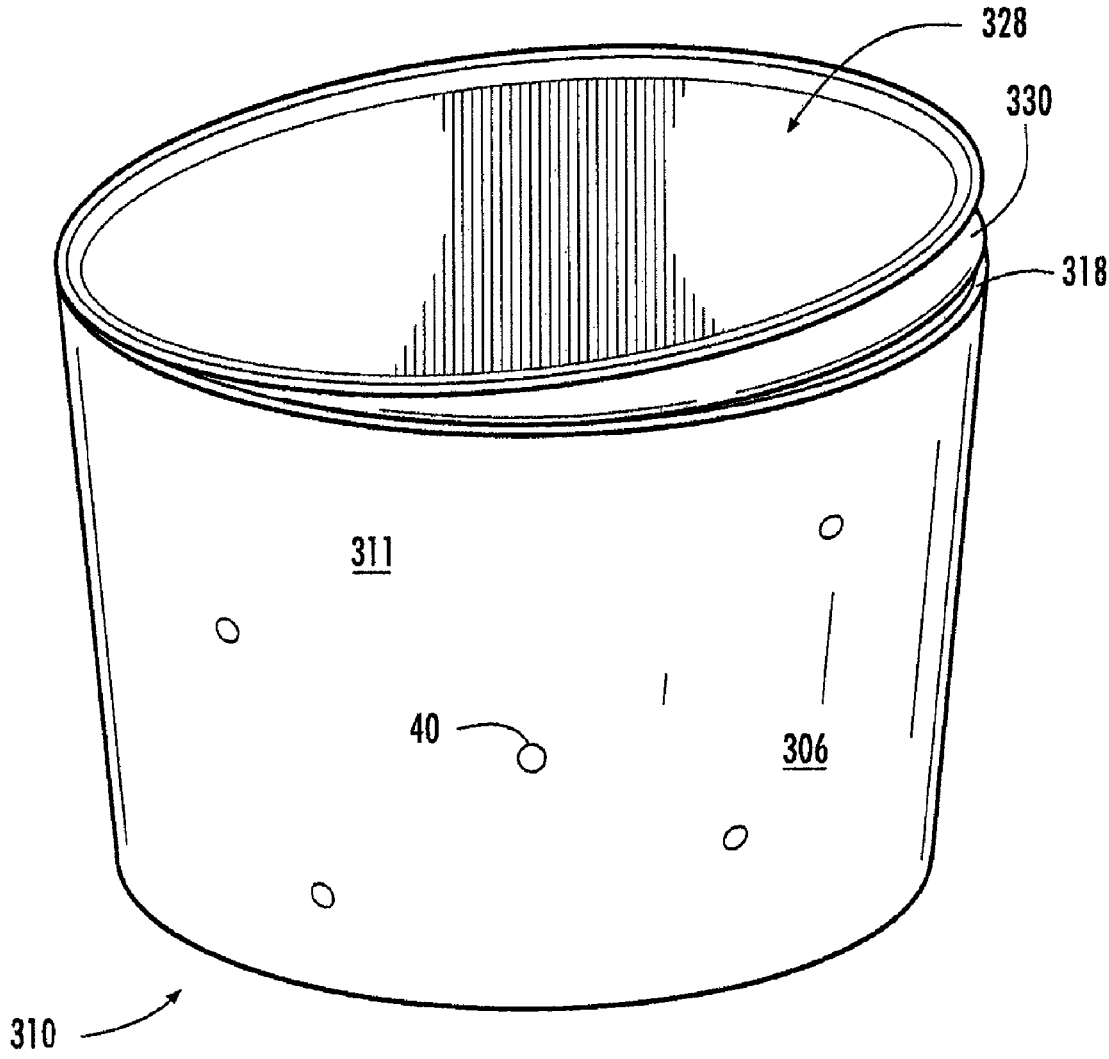
FIG. 7 is a perspective view of the container shown in FIG. 5.

FIG. 1 is a top plan view of a blank 10 of sheet material for constructing a container 300 (shown in FIGS. 5-7). More specifically, blank 10 is for constructing a shell 302 (shown in FIGS. 5-7) of container 300. In the exemplary embodiment, container 300 and/or shell 302 are substantially elliptical, as shown in FIGS. 5-7. The container 300 could have other shapes (e.g., circular, square, rectangular, etc.) without departing from the disclosure. Referring to FIG. 1, blank 10 has a first or interior surface 12 and an opposing second or exterior surface 14. Further, blank 10 defines a leading edge 16 and an opposing trailing edge 18. In the exemplary embodiment, blank 10 includes a body panel 20 that extends between leading edge 16 and trailing edge 18. Body panel 20 has a length $L_T$. Alternatively, blank 10 may include a plurality of panels that extend between leading edge 16 and trailing edge 18. For example, the blank 10 could comprise rectangular or square panels that are foldably connected by a plurality of fold lines and could comprises one or more end flaps foldably connected to the panels for closing an end of the container. A top flap 22 extends from body panel 20 along a top fold line 24 and defines a top edge 26, and a bottom flap 28 extends from body panel 20 along a bottom fold line 30 and defines a bottom edge 32. Fold lines 24 and 30, as well as other fold lines and/or hinge lines described herein, may include any suitable line of weakening and/or line of separation known to those skilled in the art and guided by the teachings herein provided. In the exemplary embodiment, top flap 22 and bottom flap 28 are each crimped with a plurality of substantially parallel fold line segments 34. Alternatively, top flap 22 and/or bottom flap 28 may be substantially smooth and not crimped. Further, in the exemplary embodiment, top flap 22 and bottom flap 28 each include a taper corner 36 and 38, respectively, that is adjacent to leading edge 16. Also, the top flap 22 and/or the bottom flap 28 could be omitted or could be otherwise shaped, arranged, and/or configured without departing from the disclosure.

In the exemplary embodiment, a plurality of openings 40 are defined through body panel 20. Openings 40 have any size, shape, orientation, and/or configuration that enables blank 10 to function as described herein. For example, openings 40 may be sized to receive at least a portion of a light source 142 (shown in FIG. 3), as described in more detail below. In an alternative embodiment, blank 10 includes one opening 40. Further, in the exemplary embodiment, at least one film sheet 42 is attached to interior surface 12 and substantially covers at least one opening 40. Film sheet 42 is flexible and light permeable such that at least a portion of light source 142 may be received with opening 40, with film sheet 42 positioned between light source 142 and opening 40. Film sheet 42 also allows light emitted from light source 142 to be emitted through opening 40. In the exemplary embodiment, film sheet 42 is formed from any suitable transparent and/or semi-transparent material. In one embodiment, the film sheet 42 comprises a thermoplastic polymer film (e.g., polyethylene terephthalate (PET) film), but the film sheet 42 could comprise other suitable materials (e.g., polypropylene or other suitable polymer).

More specifically, the film sheet 42 is attached to interior surface 12 using at least one glue strip 44. In another embodiment, at least one film sheet 42 is attached to exterior surface 14 of blank 10. In the exemplary embodiment, one film sheet 42 covers a first group 46 of openings 40, and another film sheet 42 covers a second group 48 of openings 40. Alternatively, any suitable number of film sheets 42 cover any number of openings 40. In an alternative embodiment, blank 10 does not include film sheet 42. Further, film sheet 42 may include printing, such as graphics and/or text, thereon. In one embodiment, blank 10 includes a plurality of layers of film sheet 42 such that one layer substantially overlaps another layer. In another embodiment, both film sheet 42 and exterior surface 14 of body panel 20 and/or blank 10 include graphics applied thereon such that the graphics on film sheet 42 combines with the graphics on body panel 20 and/or blank 10 to visually create an image using the layering of film sheet 42 and body panel 20 and/or blank 10. Alternatively, graphics on film sheet 42 may be unrelated to the graphics on body panel 20 and/or blank 10.

Figure 2:
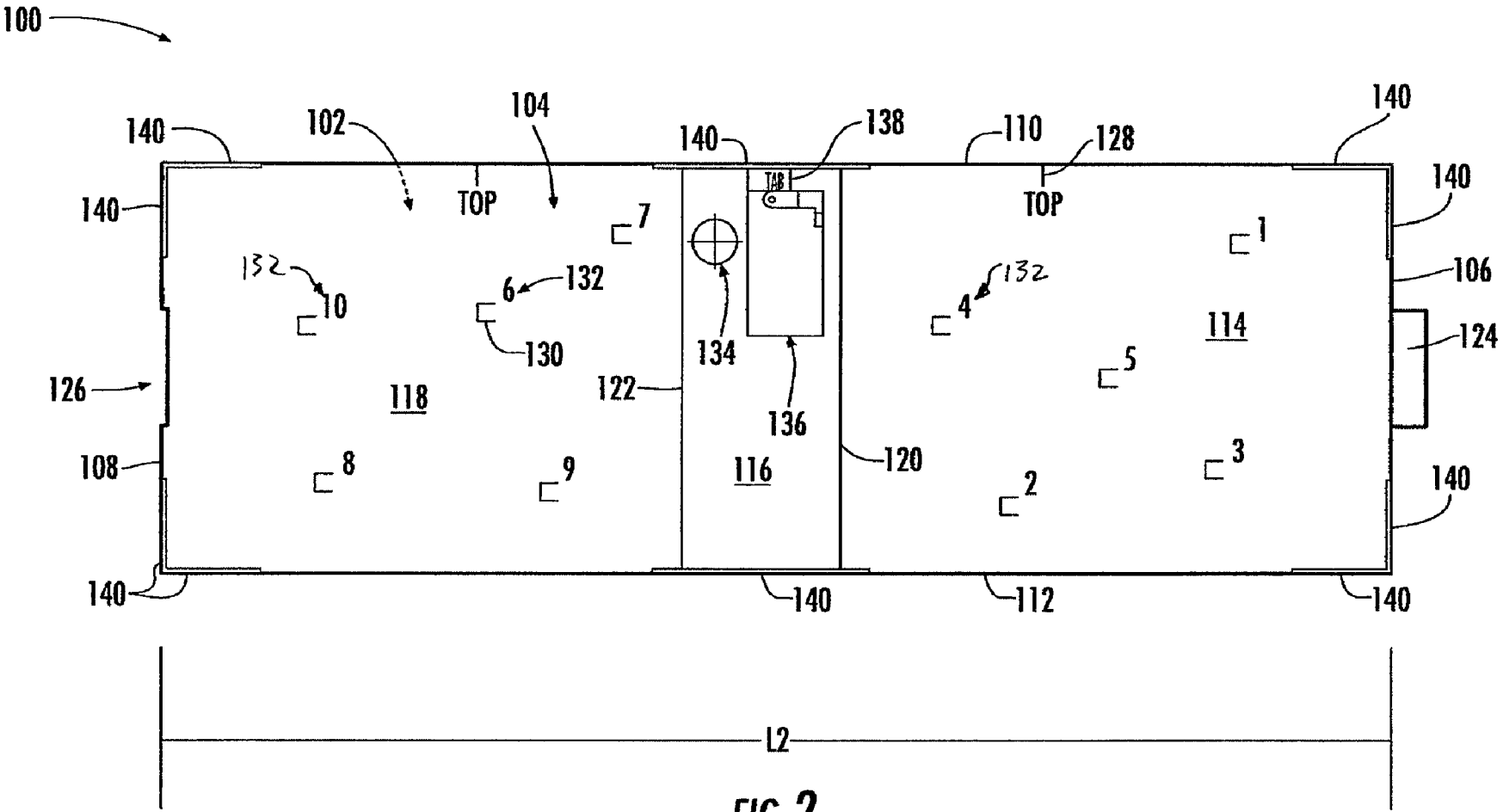
FIG. 2 is a top plan view of a blank of sheet material for constructing a liner that may be used with the blank shown in FIG. 1.

FIG. 2 is a top plan view of a blank 100 of sheet material for constructing container 300 (shown in FIGS. 5-7), and more particularly, for constructing an internal liner 304 (shown in FIGS. 5 and 6) that may be used with container 300. Blank 100 may be used with blank 10 (shown in FIG. 1). More specifically, blank 100 is sized to substantially overlap body panel 20 (shown in FIG. 1) when container 300 is assembled. In the exemplary embodiment, blank 100 has a length L2 that is shorter than length $L_1$ of blank 10 to take into account the curvatures of container 300 and liner 304 when assembled.

Blank 100 has a first or interior surface 102 and an opposing second or exterior surface 104. Further, blank 100 defines a leading edge 106 and an opposing trailing edge 108, and a top edge 110 and an opposing bottom edge 112. In the exemplary embodiment, blank 100 includes a plurality of adjacent substantially rectangular panels 114, 116, and 118 that are connected together by a plurality of preformed, generally parallel, fold lines 120 and 122, respectively. Specifically, the adjacent rectangular panels include a first body panel 114, a center panel 116, and a second body panel 118. First body panel 114 extends from leading edge 106 to fold line 120, center panel 116 extends from first body panel 114 along fold line 120, and second body panel 118 extends from center panel 116 along fold line 122. In the exemplary embodiment, a tab 124 extends from leading edge 106, and a notch 126 is defined within trailing edge 108 such that tab 124 and notch 126 substantially align when liner 304 is assembled. Blank 100 may include any suitable number of tabs 124 and/or notches 126. Blank 100 includes cut line segments 128 that extend from top edge 110 toward bottom edge 112. When corresponding center lines are printed on a center of each side of top flap 22 of blank 10, the alignment of blanks 10 and 100 may be verified by aligning cut line segment 128 with a corresponding center line. In an alternative embodiment, blank 100 includes fold-over panels such that assembled blank 100 has a double thickness and electronics, as described herein, are coupled between the folded-over panels.

In the exemplary embodiment, blank 100 includes printing on exterior surface 104 to facilitate aligning liner 304 within container 300, as described herein. More specifically, blank 100 includes a plurality of printed light targets 130. Light targets 130 are sized, shaped, configured, and/or oriented for positioning light source 142 (shown in FIG. 3) on top of a respective light target 130, as described herein. Further, a number of light targets 130 is equal to a number of openings 40 (shown in FIG. 1). In an alternative embodiment, the number of light targets 130 is greater than the number of openings 40. In the exemplary embodiment, light targets 130 are positioned to take into account the dimensions and/or configuration of blanks 10 and 100 when assembled such that light sources 142 and/or light targets 130 are substantially aligned with respective openings 40 when a reference point on assembled blank 100 is aligned with a reference point on assembled blank 10. More specifically, in the exemplary embodiment, light targets 130 are positioned to take into account the curvature, radius, circumference, height, and/or any other features and/or characteristics of container 300 and/or liner 304 when assembled. Further, light targets 130 are positioned such that light sources 142 are substantially aligned when leading edge 106 of assembled blank 100 is aligned with leading edge 16 of blank 10. Alternatively, the reference points may be other than leading edges 106 and/or 16.

In the exemplary embodiment, light targets 130 are included on first body panel 114 and second body panel 118, however, light targets 130 may be included at any suitable location on blank 100 that enables container 300 to function as described herein. Moreover, in the exemplary embodiment, each light target 130 includes an indicator 132 to indicate the correspondence between a light target 130 and a respective light source 142. For example, each light target 130 includes an Arabic numeral (e.g., "1", "2", "3" . . . etc.) as the indicator 132, wherein the indicator indicates which light source 142 is to be coupled to blank 100 within a corresponding light target 130. More specifically, light source 142 indicated by the indictor 132 corresponding to the numeral "6" is coupled to blank 100 within light target 130 having indicator 132 of "6".

Blank 100 also includes, in the exemplary embodiment, a printed sensor target 134 and a printed controller target 136. Sensor target 134 and controller target 136 are included on center panel 116, however, targets 134 and/or 136 may be included an any suitable location on blank 100. Sensor target 134 is sized, shaped, and/or oriented to correspond to a sensor 144 (shown in FIG. 3), and controller target 136 is sized, shaped, and/or oriented to correspond to a controller 200 (shown in FIGS. 3 and 4). Furthermore, in the exemplary embodiment, controller target 136 includes a tab target 138 for aligning an activation tab 154 (shown in FIG. 3) with respect to blank 100.

Additionally, blank 100 includes at least one register line 140 printed thereon. More specifically, in the exemplary embodiment, blank 100 includes register lines 140 extending along top edge 110 of first body panel 114, center panel 116, and second body panel 118. Register lines 140 also extend along bottom edge 112 of first body panel 114, center panel 116, and second body panel 118. Register lines 140 also extend along leading edge 106 of first body panel 114, and along trailing edge 108 of second body panel 118. Alternatively, register lines 140 are included at any suitable location and/or orientation with respect to blank 100 that enables blank 100 to function as described herein. In the exemplary embodiment, register lines 140 are configured to facilitate the print-to-cut register in the printing and die-cutting of blank 100 such that correct alignment of the printed targets 130, 132, 134, 136, and 138 onto blank 100 can be ascertained.

Furthermore, blank 100 may include printing, such as text and/or graphics, on exterior surface 104 that may combine with printing on film sheet 42 (shown in FIG. 1) and/or exterior surface 104 (shown in FIG. 1) of blank 10 to display an image.

Figure 3:
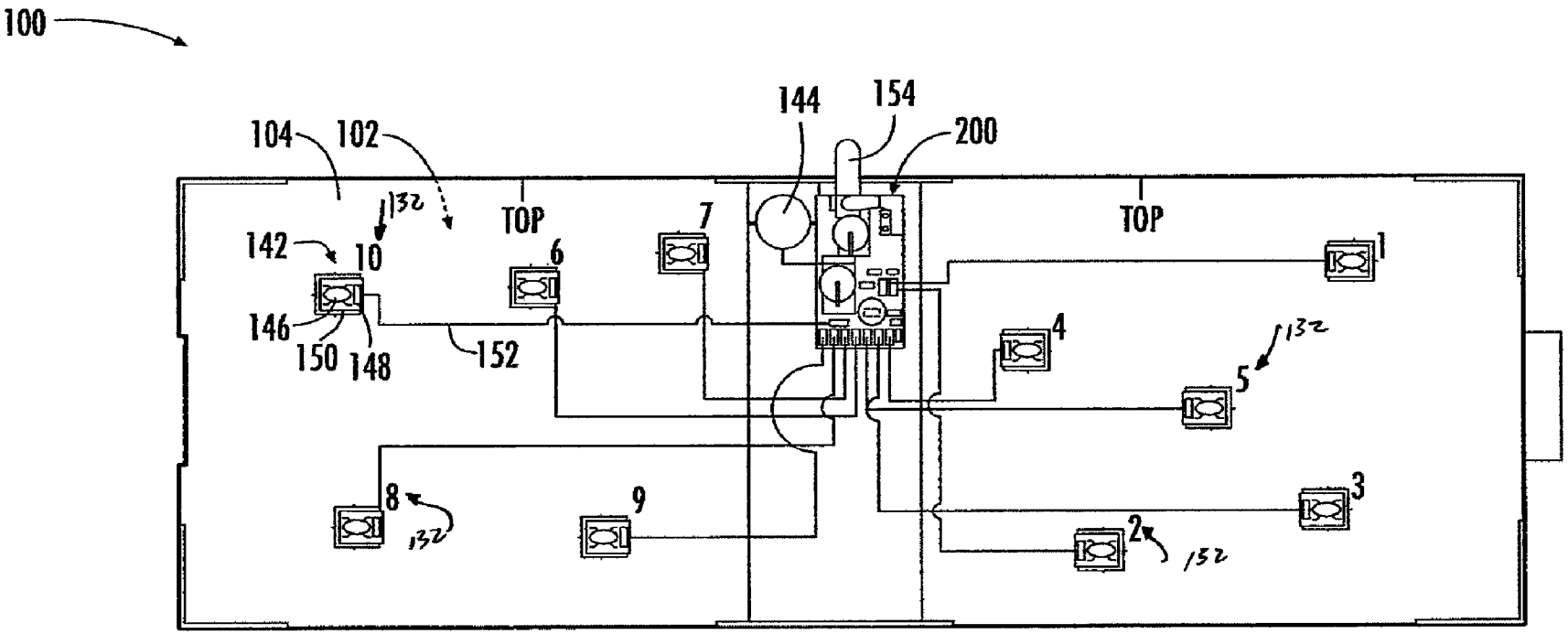
FIG. 3 is a top plan view of the blank shown in FIG. 2 including electronic components.

FIG. 3 is a top plan view of blank 100 including electronic components. More specifically, blank 100 includes at least one light source 142, sensor 144, and controller 200. In the exemplary embodiment, light source 142, sensor 144, and/or controller 200 are attached to blank 100 using an adhesive and/or any other suitable attachment means that enables blank 100 to function as described herein.

Light source 142 may be a light-emitting diode (LED), a fluorescence light source, a phosphorescence light source, an incandescent light source, a gas discharge light source, and/or any other suitable lighting source. In the exemplary embodiment, light source 142 is an LED 146, including electrical connection pads 148, coupled to a substrate 150, such as a printed circuit board (PCB). Further, in the exemplary embodiment, blank 100 includes a number of light sources 142 that is equal to the number of openings 40 (shown in FIG. 1). Alternatively, blank 100 includes more light sources 142 than openings such that more that one light source 142 is associated with an opening 40. Light source 142 is illustrated as substantially rectangular with corresponding rectangular light targets 130 (shown in FIG. 2), however, light sources 142 and/or corresponding light targets 130 may have any size, shape, orientation, and/or configuration that enables blank 100 to function as described herein.

Sensor 144 may be a thermal sensor, an electrical sensor, a magnetic sensor, a mechanical sensor, a chemical sensor, an optical radiation sensor, an acoustic sensor, a motion sensor, a touch sensor, an orientation sensor, a distance sensor, an accelerometer and/or any other suitable sensor that emits an electric signal that is indicative that a predetermined condition has been sensed and enables blank 100 to function as described herein. In the exemplary embodiment, sensor 144 senses a relatively abrupt movement of blank 100 and/or container 300. More specifically, upon sensing a movement of blank 100 and/or container 300, sensor 144 transmits a signal to controller 200 to activate at least one light source 142. In another embodiment, sensor 144 senses when a product, such as a facial tissue, is removed from container 300, and activates at least one light source 142 when the product is removed from container 300. In yet another embodiment, sensor 144 senses when a person approaches container 300 and activates at least one light source 142. As such, light source 142 may be inactive for a period of time and then activated by sensor 144 and controller 200 to facilitate conserving stored energy that powers light sources 142.

Figure 4:
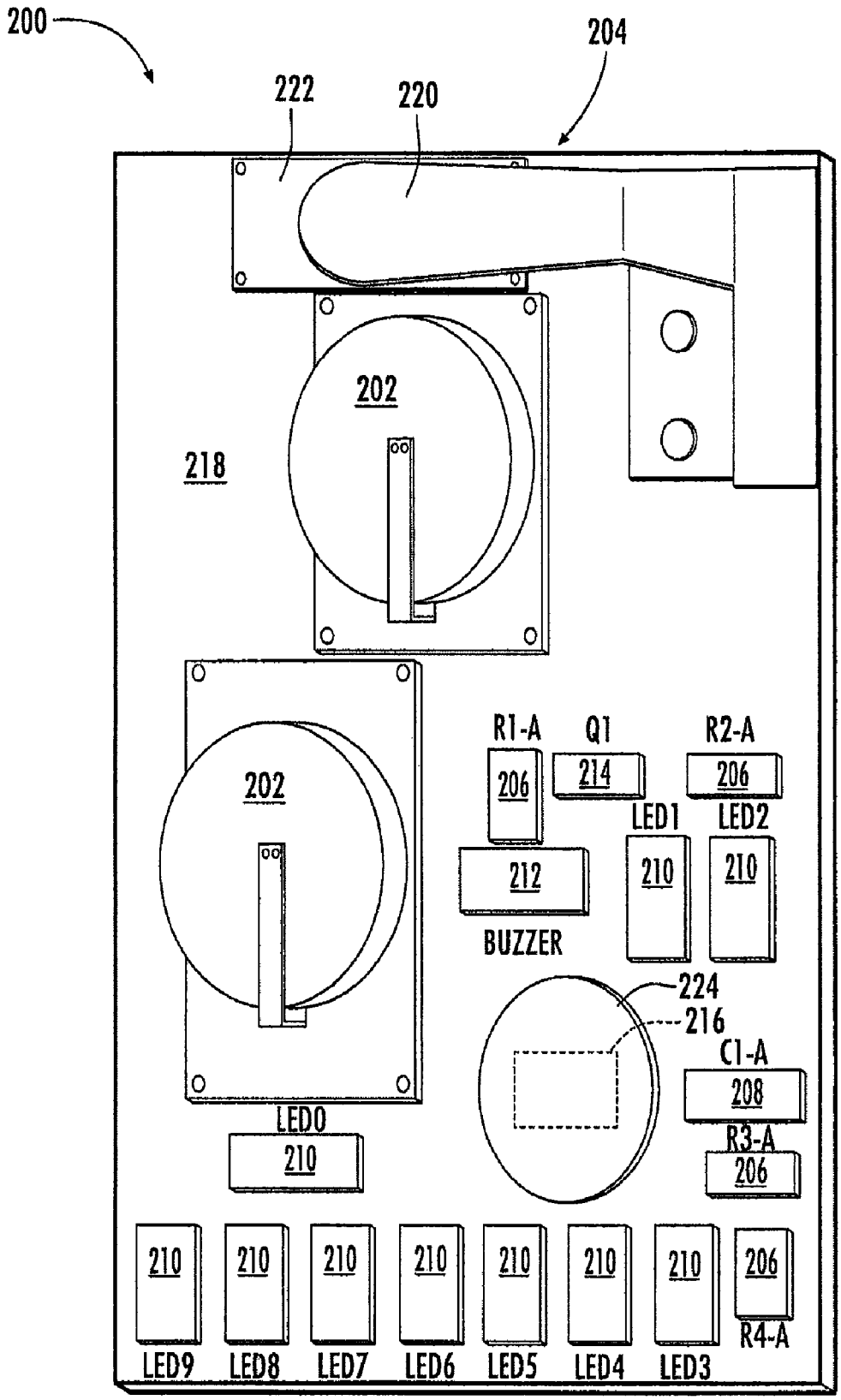
FIG. 4 is a top plan view of an exemplary controller that may be used with the blank shown in FIG. 3.

In the exemplary embodiment, controller 200 is operatively coupled to light sources 142 and sensor 144 using, for example, wires 152. As used herein, the term "controller" is not limited to only those integrated circuits referred to in the art as a controller, but broadly refers to a computer, a processor, a microcontroller, a microcomputer, a programmable logic controller, an application specific integrated circuit, and/or any other programmable circuit. FIG. 4 is a top plan view of an exemplary controller 200 that may be used with blank 100. Referring to FIGS. 3 and 4, controller 200 includes a power source, such as batteries 202, an activation switch 204, at least one resistor 206, at least one capacitor 208, at least one light source connection pad 210, at least one sensor connection pad 212, at least one transistor 214, and at least one integrated circuit (IC) 216 coupled to a substrate, such as PCB 218. In an alternative embodiment, blank 100 and/or controller 200 also includes a microphone and/or a speaker.

In the exemplary embodiment, activation switch 204 includes a first portion 220 and a second portion 222 such that when first portion 220 contacts second portion 222 current flows from batteries 202 to other components of controller 200 and/or to light source 142 and/or sensor 144. In the exemplary embodiment, activation tab 154 is positioned between first portion 220 and second portion 222 to deactivate controller 200. Activation tab 154 is formed from paper and/or any other non-conductive material. When activation tab 154 is removed from controller 200, controller 200 is activated by activation switch 204. When activation tab 154 is repositioned between first portion 220 and second portion 222, controller 200 is deactivated such that light sources 142 do not emit light. As such, activation tab 154 may be used to preserve the power within batteries 202 until a user desires light sources 142 to be activated. Accordingly, batteries 202 may remain charged until container 300 is purchased by a consumer who may then selectively remove and/or replace activation tab 154 to enable and/or disable controller 200 and/or light sources 142. In an alternative embodiment, activation switch 204 and activation tab 154 are replaced by any other suitable switching mechanism to activated/de-activate and/or cycle controller 200.

Further, light source connection pad 210 enables light source 142 to be operatively coupled to controller 200, and sensor connection pad 212 enables sensor 144 to be operatively coupled to controller 200. In the exemplary embodiment, a number of light source connection pads 210 is equal to the number of light sources 142, and a number of sensor connection pads 212 is equal to a number of sensors 144. More specifically, each light source 142 is coupled to a corresponding light source connection pad 210. For example, light source 142 indicated as "6" coupled to light source connection pad 210 indicated as "LED6". Further, in the exemplary embodiment, IC 216 is covered by a protective material 224. In an alternative embodiment, IC 216 is exposed and does not include protective material 224.

When controller 200 is activated by activation switch 204, batteries 202 power other components of controller 200 to activate light sources 142, which emit light. After a predetermined time lapse, IC 216 deactivates light sources 142 such that no light is emitted. When sensor 144 senses a predetermined condition, such as an abrupt movement of blank 100 and/or container 300, sensor 144 transmits a signal to controller 200 via wires 152 and sensor connection pads 212, and transistor 214 receives power from batteries 202. Transistor 214 is operatively coupled to IC 216, and IC 216 activates at least one light source 142 via light source connection pad 210 and wires 152. As such, the signal from sensor 144 activates light sources 142 via controller 200.

More specifically, in the exemplary embodiment, IC 216 is programmed to alternately activate and deactivate each light source 142 individually such that when a plurality of light sources 142 are viewed together, lights sources 142 appear to randomly blink with respect to exterior surface 104 of blank 100 and/or exterior surface 311 of container 300. After a predetermined time lapse, IC 216 deactivates all light sources 142. Alternatively, IC 216 is programmed to activate and/or deactivate light sources 142 in any suitable manner, including, but not limited to, activating all light sources 142 and/or activating and deactivating light sources 142 in a sequential pattern. In the exemplary embodiment, when all light sources 142 are deactivated, light sources 142 may be reactivated by the signal from sensor 144. Controller 200 is deactivated by inserting activation tab 154 between first portion 220 and second portion 222 of switch 204.

FIG. 5 is a perspective view of container 300 formed blanks 10 and 100 (shown in FIGS. 1-3). FIG. 6 is a top view of container 300. FIG. 7 is a perspective view of container 300. In the exemplary embodiment, container 300 includes a shell 302 and a liner 304. More specifically, shell 302 of container 300 is formed from blank 10, and liner 304 is formed from blank 100.

One exemplary method of assembling the container 300 from the blanks 10, 100 will now be discussed. Other suitable methods of assembly are within the scope of this disclosure. For example, each of the blanks 10, 100 may comprise multiple blanks. To assemble container 300 from blanks 10 and 100, in one exemplary embodiment, shell 302 is assembled from blank 10 and liner 304 is assembled from blank 100. Referring to FIGS. 1 and 5-7, shell 302 is assembled by coupling, by, for example, using an adhesive, leading edge 16 to trailing edge 18. More specifically, trailing edge 18 overlaps leading edge 16 and a portion 50 of exterior surface 14 of body panel 20 to define a substantially continuous side wall 306. Alternatively, when the shell 302 is more parallelogram shaped, or the like, it includes multiple side walls. Bottom flap 28 is folded at fold line 30 such that bottom flap 28 at trailing edge 18 substantially encloses bottom tapered corner 38. A bottom panel 308 is inserted into shell 302 and contacts bottom edge 32. Bottom panel 308 is typically coupled within shell 302 using an adhesive, heat sealing of a polyethylene coating, and/or any other suitable means that enables container 300 to function as described herein. Bottom panel 308 defines a bottom wall 310 of shell 302 and container 300. Alternatively, bottom panel 308 can be inserted into the container 300 and the bottom flap 28 can be folded in so that the edge portion of the bottom panel is positioned between the inside surface 12 of the bottom flap and the interior surface of the body panel 20. Alternatively, the bottom panel 308 may be a flap of the blank 10. An exterior surface 311 of container 300 is defined by exterior surface 14 of blank 10.

In one exemplary embodiment, side wall 306 and bottom wall 310 define a shape of container 300. More specifically, in the exemplary embodiment, container 300 as a substantially elliptical cross-sectional shape, such that container 300 has a major axis 312 and a minor axis 314 that are substantially perpendicular to a center axis 316. Alternatively, container 300 may have any suitable cross-sectional shape that enables container 300 to function as described herein. Further, in one exemplary embodiment, top flap 22 is folded at fold line 24 and at least partially defines a top edge of the container 300 that is adjacent a top opening 318 of container 300. More specifically, top opening 318 is at least partially defined by exterior surface 14 of top flap 22. In the exemplary embodiment, top flap 22 at trailing edge 18 substantially encloses top tapered corner 36. Top flap 22 is secured to body panel 20 such that interior surface 12 of top flap 22 contacts interior surface 12 of body panel 20. Alternatively, top flap 22 is folded and secured after liner 304 is inserted into shell 302.

Referring to FIGS. 2 and 5-7, to assemble liner 304, in the exemplary embodiment, first body panel 114 is folded toward interior surface 102 along fold line 120, and second body panel 118 is folded toward interior surface 102 along fold line 122. Trailing edge 108 is rolled toward interior surface 102, and leading edge 16, including a portion of first body panel 114 is positioned such that first body panel 114 at least partially circumscribes second body panel 118. More specifically, trailing edge 108 and leading edge 106 are positioned such that liner 304 has a substantially smaller circumference than assembled shell 302.

In one embodiment, liner 304 can be inserted into shell 302, with the bottom edge 112 of the liner first, such that leading edge 106 of liner 304 is approximately aligned with leading edge 16 of shell 302. The liner 304 is allowed to expand such that trailing edge 108 contacts leading edge 106, and body panels 114 and 118 do not overlap. More specifically, edges 108 and 106 are aligned such that notch 126 engages tab 124 to secure edges 108 and 106 with respect to each other. Liner 304 is positioned such that leading edge 106 of liner 304 is substantially aligned with leading edge 16 of shell 302. In the exemplary embodiment, by aligning leading edges 106 and 16, light sources 142 coupled to liner 304 are facilitated to be substantially aligned with respective openings 40. More specifically, by aligning leading edges 106 and 16, each light source 142 is received within a corresponding opening 40 such that the light may be emitted though opening 40. In the case where film sheet 42 is attached to interior surface 12 of blank 10, light source 142 is still received within opening 40 because film sheet 42 is flexible and allows light source 142 to be received within opening 40.

Once liner 304 has been inserted into shell 302, the exterior surface 104 of liner 304 can be in generally face-to-face relationship with the interior surface 12 of the shell 302. Further, the exterior surface 104 of the liner 304 can be in contact with the interior surface 12 of shell 302. The liner 304 may be secured (e.g., attached) to shell 302 using, for example, adhesive and/or any other suitable materials or devices. Alternatively, container 300 may include partitions that extend between opening 40 and light source 142 such that liner 304 is spaced from shell 302. In the exemplary embodiment, liner 304 substantially isolates electronics on exterior surface 104 of liner 304 from a cavity 320 of container 300. Further, when inserted within shell 302, liner 304 is substantially elliptically-shaped such that the volume of liner 304 is approximately equal to the volume of shell 302, except that one end 322 of the ellipse is truncated by a controller space 324 that is defined by exterior surface 104 of center wall 116 and interior surface 12 of shell 302. Moreover, cavity 320 of container 300 and an interior surface 326 of container 300 are defined by interior surface 102 of liner 304. The cavity 320 may contain a product therein.

In the exemplary embodiment, controller 200 and sensor 144 are positioned within the controller space 324, and light sources 142 are coupled within openings 40 of the shell 302. More specifically, light sources 142 may protrude partially into a respective opening 40 of the shell without extending through opening 40 beyond exterior surface 14 of shell 302. In an alternative embodiment, light source 142 is substantially flush with interior surface 12 of shell 302. In yet another alternative embodiment, light source 142 extends through opening 40 and beyond exterior surface 14 of shell 302.

Further, in the exemplary embodiment, film sheet 42 extends between light source 142 and opening 40 when liner 304 is inserted within shell 302.

In one alternative method of assemble of the container 300, the liner blank 100 can be coupled to shell blank 10 prior to forming the liner 304 and the shell 302. The leading edge 106 of the liner blank 100 is substantially aligned with leading edge 16 of the shell blank 10. The attached blanks 100 and 10 are then rolled toward interior surface 102 of blank 100 such that trailing edge 108 contacts leading edge 106 and trailing edge 18 contacts leading edge 16. Trailing edge 18 is secured to leading edge 16 using any suitable fastener, such as adhesive and/or heat sealed polyethylene coating, and trailing edge 108 is coupled to leading edge 106 using notch 126 and tab 124. Bottom flap 28 is folded toward interior surface 12 about fold line 30 and interior surface 12 of bottom flap 28 is secured to interior surface 12 body panel 20. Bottom panel 308 is inserted into container 300 and contacts bottom edge 32. Bottom panel 308 is coupled within container 300 using an adhesive and/or any other suitable means that enables container 300 to function as described herein. Alternatively, bottom panel 308 can be inserted into container 300 and then bottom flap 28 can be folded in so that the edge portion of bottom panel 308 is held between the inside surface 12 of bottom flap 28 and the interior surface of body panel 20. Further, top flap 22 is folded at fold line 24 and secured to body panel 20 such that interior surface 12 of top flap 22 contacts interior surface 12 of body panel 20.

Referring to FIG. 7, the container 300 may include a lid 328. Lid 328 may be fabricated from paper, paperboard, foam board, plastic, plastic film, molded pulp, and/or any other suitable materials. Lid 328 may include an opening therethrough to facilitate accessing cavity 320 of container 300. In the exemplary embodiment, lid 328 is configured to fit within top opening of container 300. When lid 328 is inserted into top opening 318, an exterior axial surface 330 of lid 328 contacts exterior surface 14 of top flap 22. The container 300 can include lids being otherwise shaped, arranged, and/or positioned or the lid 328 can be omitted without departing from the disclosure.

The above-described container and blanks for making the same facilitate drawing attention to the container and/or the product therein. The above-described container includes a full liner for supporting and positioning the electronics within the assembled container and for internally concealing the electronics. With the electronics hidden from view, the cavity of the container has substantially smooth walls that facilitate protecting the product therein and/or the electronics. Further, the film between the light sources and opening allows for designs, text, and/or graphics to be printed thereon and to be illuminated by the light sources. The printed image on the film may combine with a printed image on the liner and/or shell. Further, the above-described activation tab allows the light sources to be de-activated to preserve battery power until a user wishes to activates the light sources. As such, the light sources may be activated to draw a consumer's attention to the container within a retail store and/or may be activated once the container has been purchased by the consumer who can use the container for ornamental purposes in a residential setting.

Exemplary embodiments of a container including an electronic insert and blanks for making the same are described above in detail. The container and blanks are not limited to the specific embodiments described herein. For example, the blanks may also be used in combination with other containers, and are not limited to practice with only the container and blanks as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the claims and/or the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container constructed from at least a first blank and a second blank, the container comprising:

a shell constructed from at least the first blank and having a side wall, the side wall comprising an opening;

a bottom wall;

a liner constructed from at least the second blank, the liner being attached to the shell and comprising a light source, the light source being aligned with the opening, wherein the liner comprises an exterior liner surface and an interior liner surface, and the shell comprises an interior shell surface and an exterior shell surface, the exterior shell surface comprises an exterior surface of the container and the interior liner surface comprises an interior surface of the container.

2. The container of claim 1 wherein the exterior surface of the liner is in generally face-to-face relationship with the interior surface of the shell.

3. The container of claim 1 further comprising a controller attached to the liner and operatively connected to the light source.

4. The container of claim 3 wherein the container comprises an electronic circuit, the electronic circuit comprising the light source, the controller, and a power source.

5. The container of claim 4 wherein the electronic circuit further comprises a sensor operatively connected to the controller.

6. The container of claim 4 wherein the electronic circuit further comprises an activation switch.

7. The container of claim 4 wherein the electronic circuit further comprises a microphone.

8. The container of claim 4 wherein the liner at least partially defines a cavity of the container, and the liner isolates the electronic circuit from the cavity.

9. The container of claim 4 wherein the liner comprises two curved walls and at least one substantially straight end wall extending between the two curved walls.

10. The container of claim 9 wherein a controller space is formed between the end wall and the shell, the controller being positioned within the controller space.

11. The container of claim 1 wherein the container has a substantially elliptical cross-sectional shape.

12. The container of claim 1 wherein the shell comprises a top flap that defines a top edge of the container, the top edge of the container being adjacent a top opening of the container.

13. The container of claim 12 wherein the container further comprises a lid at least partially covering the top opening.

14. The container of claim 13 wherein the lid has an external surface that fits within the top opening and contacts the exterior shell surface of the top flap.

15. A container constructed from at least a first blank and a second blank, the container comprising:

a shell constructed from at least the first blank and having a side wall, the side wall comprising an opening;

a bottom wall;

a liner constructed from at least the second blank, the liner being attached to the shell and comprising a light source, the light source being aligned with the opening, wherein the first blank has a leading edge and a trailing edge, the trailing edge overlapping the leading edge when the shell is constructed from the first blank.

16. A method of forming a container, the method comprising:

having a first blank comprising a side wall, an opening in the sidewall;

having a second blank with a light source attached thereto;

positioning the second blank relative to the first blank to substantially align the light source with the opening by forming the second blank into a liner and forming the first blank into a shell, wherein the first blank comprises an interior shell surface and an exterior shell surface, the second blank comprises an interior liner surface and an exterior liner surface, the positioning the second blank relative to the first blank comprises placing the exterior liner surface in generally face-to-face relationship with the interior shell surface.

17. The method of claim 16 further comprising inserting the liner into the shell.

18. The method of claim 17 wherein first blank has a leading edge and the second blank has a leading edge, the inserting the liner into the shell comprises aligning the leading edge of the first blank and the leading edge of the second blank.

19. The method of claim 16 wherein the second blank comprises an electronic circuit comprising a controller operatively connected to the light source, the electronic circuit being attached to the exterior liner surface.

20. The method of claim 16 wherein the liner at least partially defines a cavity of the container, and the liner isolates the electronic circuit from the cavity.

21. The method of 19 wherein forming the second blank into the liner comprises positioning two curved walls of the second blank and at least one substantially straight end wall that extends between the two curved walls.

22. The method of claim 21 wherein forming the second blank into the liner comprises forming a controller space between the end wall and the shell, the controller being positioned within the controller space.

23. The method of claim 18 further comprising positioning a bottom wall to substantially close the bottom of the container.

24. The method of claim 23 further comprising positioning a top wall to substantially close the top of the container.

25. The method of claim 18 wherein the first blank has a leading edge and a trailing edge, the second blank has a leading edge and a trailing edge, the positioning the second blank relative to the first blank comprises aligning the leading edge of the second blank with the leading edge of the first blank.

26. The method of claim 25 wherein the positioning the second blank relative to the first blank comprises attaching the exterior liner surface to the interior shell surface.

27. The method of claim 25 further comprising forming the attached first and second blanks into the container by attaching the leading edge of the first blank with the trailing edge of the first blank and attaching the leading edge of the second blank with the leading edge of the second blank.

28. The method of claim 27 wherein the forming the attached first and second blank comprises forming the container having a substantially elliptical cross-sectional shape.

29. A container constructed from at least a first blank and a second blank, the container comprising:

a shell constructed from at least the first blank and having a side wall, the side wall comprising an opening;

a bottom wall;

a liner constructed from at least the second blank, the liner being attached to the shell and comprising a light source, the light source being aligned with the opening;

a controller attached to the liner and operatively connected to the light source; and an electronic circuit, the electronic circuit comprising the light source, the controller, and a power source.

30. A method of forming a container, the method comprising:

having a first blank comprising a side wall, an opening in the sidewall and a leading edge;

having a second blank with a light source attached thereto, the second blank having a leading edge;

positioning the second blank relative to the first blank to substantially align the light source with the opening by forming the second blank into a liner and forming the first blank into a shell;

inserting the liner into the shell comprising aligning the leading edge of the first blank and the leading edge of the second blank; and positioning a bottom wall to substantially close the bottom of the container.

31. A method of forming a container, the method comprising:

having a first blank comprising a side wall, an opening in the sidewall, a leading edge, and a trailing edge;

having a second blank with a light source attached thereto, the second blank having a leading edge;

positioning the second blank relative to the first blank to substantially align the light source with the opening by forming the second blank into a liner and forming the first blank into a shell, the forming the first blank into the shell comprises overlapping the trailing edge and leading edge.

* * * * *